US006938846B1

(12) United States Patent
Kriström et al.

(10) Patent No.: US 6,938,846 B1
(45) Date of Patent: Sep. 6, 2005

(54) SCREENING APPARATUS WITH SLOT RING MOVEABLE IN AXIAL DIRECTION

(75) Inventors: Klas Kriström, Sörberge (SE); Kjell Forslund, Sundsbruk (SE)

(73) Assignee: Valmet Fibertech AB, (SE)

( * ) Notice: Subject to any disclaimer, the term of this patent is extended or adjusted under 35 U.S.C. 154(b) by 0 days.

(21) Appl. No.: 09/958,418

(22) PCT Filed: Mar. 3, 2000

(86) PCT No.: PCT/SE00/00422

§ 371 (c)(1),
(2), (4) Date: Oct. 9, 2001

(87) PCT Pub. No.: WO00/61861

PCT Pub. Date: Oct. 19, 2000

(30) Foreign Application Priority Data

Apr. 8, 1999 (SE) ..... 9901280

(51) Int. Cl.[7] ..... B02C 23/36
(52) U.S. Cl. ..... 241/46.17; 209/304; 241/74
(58) Field of Search ..... 209/273, 279, 209/282, 303–306; 241/46.17, 74

(56) References Cited

U.S. PATENT DOCUMENTS

| | | | | |
|---|---|---|---|---|
| 1,175,293 | A * | 3/1916 | Quiller | 209/270 |
| 3,713,536 | A | 1/1973 | Hooper | |
| 3,713,595 | A | 1/1973 | Craig et al. | |
| 3,953,325 | A * | 4/1976 | Nelson | 209/273 |
| 4,236,998 | A * | 12/1980 | Heys | 209/235 |
| 4,267,035 | A | 5/1981 | Martin | |
| 4,699,324 | A | 10/1987 | Ahs | |
| 4,744,894 | A | 5/1988 | Gauld | |
| 4,749,474 | A | 6/1988 | Young | |
| 4,851,111 | A | 7/1989 | Martin et al. | |
| 4,911,828 | A | 3/1990 | Musselmann et al. | |
| 5,096,127 | A | 3/1992 | Young | |
| 5,925,249 | A | 7/1999 | Fredriksson | |
| 6,170,769 | B1 | 1/2001 | Bergdahl et al. | |

FOREIGN PATENT DOCUMENTS

| | | |
|---|---|---|
| EP | 0 649 940 B1 | 4/1995 |
| GB | 2 319 196 A | 5/1998 |
| SE | 507 905 | 4/1997 |
| WO | 93/23609 | 11/1993 |
| WO | 97/13918 | 4/1997 |
| WO | 98/46821 | 10/1998 |

OTHER PUBLICATIONS

WO 9846822, Sunds Delibrator, Oct. 22, 1998.*

* cited by examiner

*Primary Examiner*—Mark Rosenbaum
(74) *Attorney, Agent, or Firm*—Lerner, David, Littenberg, Krumholz & Mentlik, LLP

(57) ABSTRACT

Apparatus for screening pulp suspensions is provided, including a housing, a rotary screen within the housing, a screen chamber between the rotary screen and the housing, a reject outlet, an accept outlet, an outer screen surface defining the outer surface of the screen chamber, a bottom screen surface defining the lower surface of the screen chamber, a slot ring at the bottom screen surface and adjacent to a knob ring at the lower end of the rotary screen, and an adjustment screw for adjusting the size of the gap between the knob ring and the slot ring from outside of the housing.

9 Claims, 2 Drawing Sheets

SCREENING APPARATUS WITH SLOT RING MOVEABLE IN AXIAL DIRECTION

FIELD OF THE INVENTION

The present invention relates to a screening apparatus for separating fibrous suspensions, preferably pulp suspensions. The screening apparatus comprises a screen housing with a screen chamber, which is defined inwardly by a rotary tubular screen, outwardly by an outer defining surface, and downwardly by a bottom portion. Lowermost on the screen means a knob ring is located. Between the knob ring and a slot ring a gap is formed. The screening apparatus further comprises an inlet for fibrous suspension to the screening apparatus, a reject outlet for reject from the screen chamber and an accept outlet for accept from the screening apparatus.

BACKGROUND OF THE INVENTION

Screening apparatus of the above type is used during both coarse and fine screening of pulp suspensions, preferably for fractionating or separating impurities and other foreign matter which is not desired to be included in the final product, such as shives, knots, coarse particles, scrap, stones or incompletely digested or unrefined chip pieces. The screening apparatus is usually pressurized.

The pulp suspension to be screened is introduced by means of an inlet to the screen chamber where the accepted fraction, the accept, flows through the rotating screen means and into an accept chamber. The accept is then guided down into a lower accept chamber and out through the accept outlet.

The lower accept chamber has the same outer diameter as the screen chamber and is located below the same.

The pulp suspension portion, which does not pass through the screen means (the reject) is discharged by means of the reject outlet, which is usually provided as a tangential outlet in the lower portion of the screen chamber.

Upon rotation of the screen means, a certain pumping effect is obtained in the gap between the knob ring and slot ring. This can result in the accept passing through the gap and out into the screen chamber, thus, preventing the pulp suspension from the screen chamber passing through the gap. In order to increase the pumping effect in the gap, the knob ring and slot ring can be given a greater extension in the radial direction.

The slot ring constitutes one unit with the bottom portion.

When the screening apparatus is in operation, the knob ring and slot ring are subjected to wear. In this manner, the gap increases in size, which results in greater amounts of accept passing through the gap, at the same time as the pumping effect deteriorates. As a consequence, pulp suspension from the screen chamber can pass through the gap. The gap preferably is not wider than the greatest opening in the screen means.

For controlling the gap width, the screening apparatus is stopped, emptied and scavenged. Thereafter, the screening apparatus is dismantled in order to make the gap width accessible to be measured. If the gap width is too great, it can be adjusted either by exchanging the entire screen means or by repairing the knob ring and/or slot ring in such a way that its original thickness is restored.

Measuring of the gap width is very tedious and troublesome. In cases when the gap is found to be too great, high costs will also be involved for repairing, and alternatively exchanging parts, which requires additional time. Due to the fact that it is so troublesome and expensive to change the gap width, the screen is kept in operation far too long, even if the gap width is greater than desirable.

SUMMARY OF THE INVENTION

In accordance with the present invention, apparatus is provided for screening a fibrous suspension comprising a housing, a rotary screen mounted for rotation within the housing, the rotary screen including an upper end, a lower end, and a knob ring disposed at the lower end of the rotary screen, a screen chamber between the rotary screen and the housing including an inner surface defined by the rotary screen, an outer surface and a lower surface, an inlet for providing the fibrous suspension to the screen chamber, a reject outlet for withdrawing a reject portion of the fibrous suspension from the screen chamber, an accept outlet for withdrawing an accept portion of the fibrous suspension from the rotary screen, an outer screen chamber surface defining the outer surface of the screen chamber, a bottom screen chamber surface defining the lower surface of the screen chamber, a slot ring associated with the bottom screen chamber surface and adjacent to the knob ring defining a gap therebetween, and adjustment means for movably adjusting the location of the slot means whereby the size of the gap may be adjusted and the fibrous suspension may be substantially prevented from passing from the screen chamber through the gap, the adjustment means being at a location whereby the gap may be adjusted from outside of the housing. Preferably, the fibrous suspension comprises a pulp suspension.

In accordance with one embodiment of the apparatus of the present invention, the adjustment means is attached to the bottom screen chamber surface. Preferably, the adjustment means comprises a rotary screw attached to the slot ring and including threads having a predetermined pitch, and wherein the rotary screw and the slot ring are movable with respect to the bottom screen chamber surface.

In accordance with another embodiment of the apparatus of the present invention, the apparatus includes support means disposed at the bottom screen chamber surface within the screen chamber, the slot ring being fittingly attached to the support means, at least a portion of the support means being movable with the slot ring. In a preferred embodiment, the support means includes an outer support ring and wherein the at least a portion of the support means comprises an inner support ring. Preferably, the support means extends over the entire bottom screen chamber surface. More preferably, the outer support ring is detachable. In a preferred embodiment, the support means extends at least partially over the outer screen chamber surface.

In accordance with another embodiment of the apparatus of the present invention, the reject outlet comprises a congruent opening in the bottom screen chamber surface, and wherein the outer support ring is rotary, whereby the congruent opening of the reject outlet is adjustable thereby.

In accordance with the present invention apparatus has been provided in which the measuring and adjusting of the gap width can be carried out much faster and considerably simpler than by processes known in the art. The gap width can thus be adjusted as often as it is required for always maintaining a desired gap width.

The slot ring of the present invention is movable in the axial direction in relation to the bottom portion by means of at least one gap adjustment device. Every gap adjustment device is located in the bottom portion, and can be operated from the outside of the screening apparatus. The gap width can thus be measured and adjusted without requiring the screening apparatus to be emptied of pulp suspension, cleaned and dismantled.

The bottom portion preferably has its lower side on the outside of the screening apparatus. This means that the lower accept chamber, which in the prior art is located below the screen chamber, is given a limited outer diameter, so that the lower accept chamber has a diameter, which at maximum is preferably of equal size as the diameter of the lowermost portion of the screen means.

The slot ring usually has a lesser extension in the radial direction. Depending on the design of the screening apparatus, the lower accept chamber can interfere with the gap adjustment device. The slot ring, therefore, is preferably located on a support means provided in the screen chamber at the bottom portion thereof. The support means is provided with at least a sufficient extension in the radial direction that the gap adjustment device can be at a location which is easily accessible from outside the lower accept chamber.

The slot ring is located so that the pulp suspension substantially cannot pass between the slot ring and bottom portion, that is between the screen chamber and the lower accept chamber.

Another advantage obtained with the present invention is that when the screening apparatus comprises a support means it is possible to make at least a part of the support means exchangeable. This exchangeable part can then be utilized as a wearing part.

When the reject outlet is an opening in the bottom portion of the screen chamber, and the support means is located entirely or partially over the opening in the bottom portion, a corresponding opening is made in the support means. The reject outlet thereby becomes the congruent portion of the two openings. The support means can be formed as an outer support ring and an inner support ring. By placing the opening for the reject outlet in the outer support ring, and pivotally arranging the outer support ring, and the congruent portion of the two openings can be changed by turning the outer support ring, whereby the reject outlet can be controlled.

BRIEF DESCRIPTION OF THE DRAWINGS

The present invention is described in greater detail in the following detailed description, in which.

DETAILED DESCRIPTION

Figure 1:
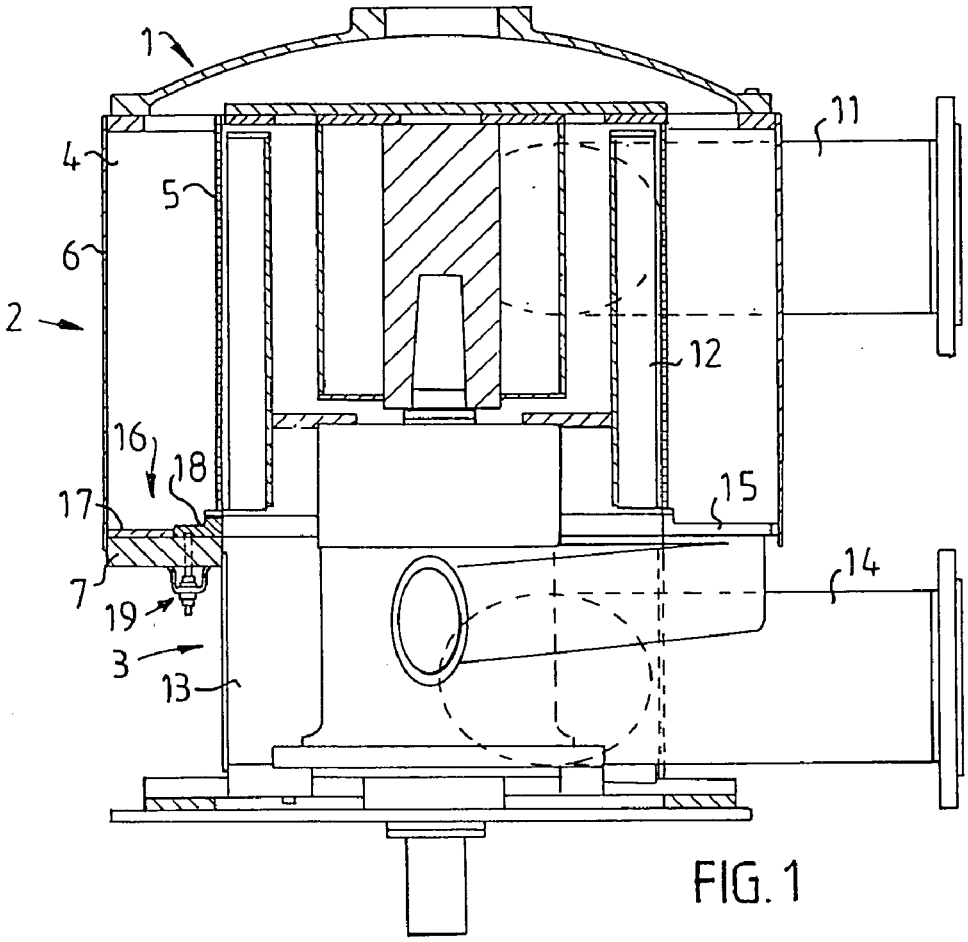
FIG. 1 is a side, elevational, partially sectional view of a preferred embodiment of a screening apparatus according to the present invention.
Figure 2:
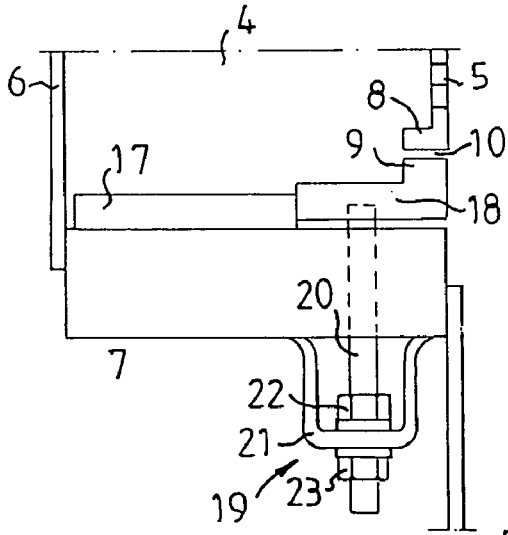
FIG. 2 is a side, elevational, enlarged view of one embodiment of the gap adjustment device and the gap shown in FIG. 1.

The screening apparatus shown in FIG. 1 comprises a pressurized screen housing 1 with an upper portion 2, the diameter of which is greater than the lower portion 3 of the screen housing 1. In the upper portion 2 of the screen housing a screen chamber 4 is located, which is defined inwardly by a rotationally symmetrical rotary tubular screen means 5, is defined outwardly by an outer defining surface 6, and is defined downwardly by a bottom portion 7, which has its lower side on the outside of the screening apparatus.

Between a knob ring 8 located on the lowermost portion of the screen means 5 and a slot ring 9, a gap 10 is formed.

The fibrous suspension to be separated, which in this case is a pulp suspension, is introduced by means of an inlet 11 in the upper portion 2 of the screen housing 1 to the screen chamber 4. The accepted fraction (the accept) of the pulp suspension flows through the rotating screen means 5 and into an accept chamber 12. The accept flows thereafter down to a lower accept chamber 13 and out through the accept outlet 14.

The pulp suspension portion in the screen chamber 4 which does not pass through the screen means 5, flows out through a reject outlet 15 in the bottom portion 7.

Upon rotation of the screen means 5 a pumping effect in the gap 10 is obtained. By increasing the width of the gap 10 in radial direction, this pumping effect is increased.

Owing to the pumping effect, accept flows from the accept chamber 12 through the gap 10 and out into the screen chamber 4. The pulp suspension in the screen chamber 4 is thereby prevented from flowing into the accept chamber 12.

The slot ring 9 is located with a tight fit on a support means 16, which is provided in the screen chamber 4 at the bottom portion 7. The support means 16 extends over the entire bottom portion 7 and is divided into an outer and an inner support ring, 17 and 18, where the slot ring 9 is formed as one unit with the inner support ring 18. The outer support ring 17 is detachably fastened on the bottom portion 7. The inner support ring 18 with the slot ring 9 is movable in the axial direction by means of at least one gap adjustment device 19. Every gap adjustment device 19 is located at the bottom portion 7, and is operable from the outside of the screening apparatus. The gap width thus can be changed from the outside of the screening apparatus.

The gap adjustment device 19 comprises a screw means 20, which has threads with a definite pitch. The screw means 20 extends through a hole in the bottom portion 7 and is fastened in the inner support ring 17, and extends further through a hole in a yoke 21 attached below the bottom portion 7. On the screw means 20, on the respective side of the hole in the yoke 21, an inner and outer nut, 22 and 23, respectively, are located.

When the gap width is to be changed, and the slot ring 9 is thus to be moved in the axial direction, the slot ring 9 is moved by the gap adjustment device 19 all the way to the knob ring 8. From this position the slot ring 9, and thereby the inner support ring 18, are moved by the gap adjustment device 19 back from the knob ring 8 until the desired gap width is achieved. For moving the screw means 20, and thus the slot ring 9, the nuts, 22 and 23, are turned. Knowledge of the pitch angle of the threads of the screw means 20 and of the turned angle of the nuts, 22 and 23, renders it possible to calculate the width of the gap 10.

The gap adjustment device can also be designed in a different way. The hole through the bottom portion, for example, can be threaded on the inside, and the threads of the screw means thereby work against the threads in the hole of the bottom portion, when the slot ring is to be moved.

The outer support ring 17 is arranged against the inner support ring 18, so that the pulp suspension substantially cannot pass between the outer and inner support rings, 17 and 18, and thus substantially cannot pass between the inner support ring 18 and bottom portion 7. The outer and inner support rings, 17 and 18, must sufficiently overlap so that they are located against each other even when the slot ring 9 is moved up against the knob ring 8.

When the gap adjustment device is of the type in the embodiment shown, preferably four gap adjustment devices 19 are arranged symmetrically on the bottom portion 7.

When the support means 16 is formed as one unit, i.e. when the outer and inner support rings, 17 and 18, are formed as one unit, the support means 16 should extend all the way out to the outer defining surface 6 of the screen chamber, in order to prevent pulp suspension from penetrating in between the support means 16 and bottom portion 7 when the gap width is being adjusted. In this case the gap adjustment device 19 must be arranged so as to ensure that the support means 16 is not tilted when the gap width is to be changed. This can be effected by also arranging the gap adjustment devices 19, which work against the outer support ring 17.

Figure 3:
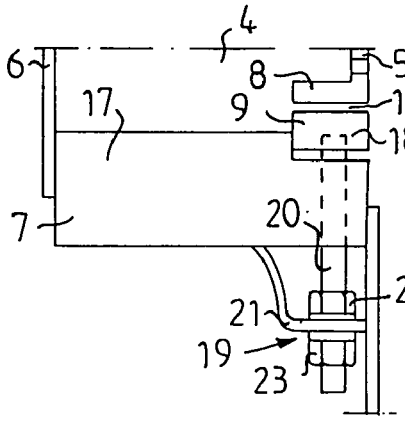
FIG. 3 is a side, elevational, enlarged view of another embodiment of the gap adjustment device according to the present invention.

Another embodiment of the present invention is shown in FIG. 3. The outer support ring 17 in this case is one unit with the bottom portion 7, and the extension of the inner support ring 18 in the axial direction coincides with the extension of the slot ring 9 in the radial direction.

Figure 4:
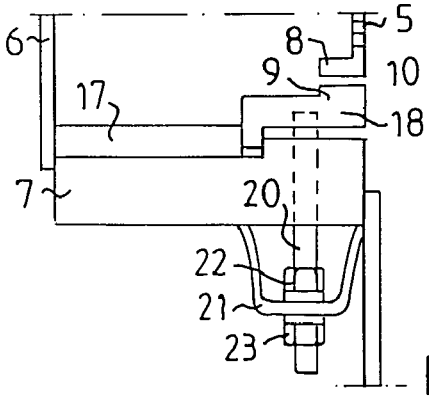
FIG. 4 is a side, elevational, enlarged view of another embodiment of the gap adjustment device according to the present invention.

FIG. 4 shows still another embodiment of the present invention. The inner support ring 18 is curved and partially guided in a groove between the bottom portion 7 and outer support ring 17.

Figure 5:
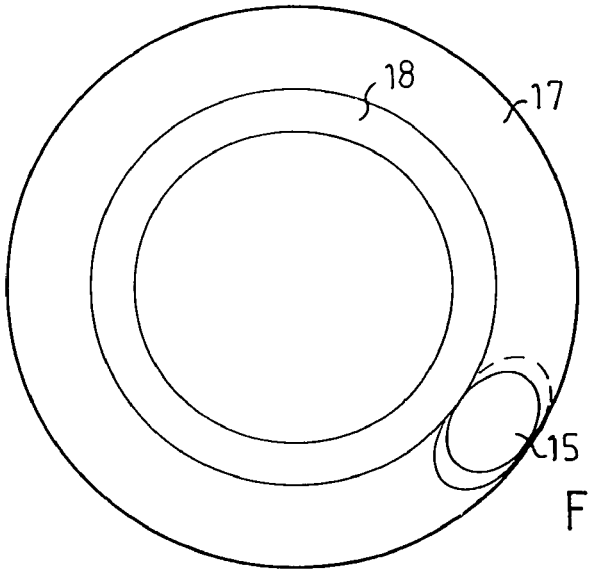
FIG. 5 is a top, elevational view of the reject outlet used in a screening apparatus of the present invention.

When the reject outlet 15 is an opening of a definite size in the bottom portion 7 of the screen chamber 4, a corresponding opening of a definite size is provided in the support means 16. The reject outlet 15 thereby becomes the congruent portion of the two openings. By placing the reject outlet 15 in the outer support ring 17 and enabling the outer support ring 17 to rotate, the size of the congruent portion of the two openings can be changed by turning the support ring 17. In FIG. 5 the reject outlet 15 is shown when the outer support ring 17 is turned so that the two openings are not entirely congruent.

In the lower portion of the screen chamber 4, coarse impurities are collected. The impurities follow along in the rotation of the screen means 5, before they are moved out through the reject outlet 15. The bottom portion 7 of the screen chamber 4 and the lower portion of the outer defining surface 6 of the screen chamber are thereby subjected to wear. The support means 16 is preferably arranged so as to extend over the entire bottom portion 7, and the outer support ring 17 is made detachable on the bottom portion 7. The outer support ring 17 can thus be exchanged when it is worn, and thereby serve as an exchangeable wear piece as protection against wear in the screen chamber 4. In order to also protect portions of the outer defining surface 6 of the screen chamber, the support means 16 can be placed so that it extends a distance up over the outer defining surface 6 of the screen chamber.

The gap width can be adjusted without requiring the screening apparatus to be dismantled and emptied of pulp suspension. In this case a certain proportion of the pulp suspension is found in the gap. By rotating the screen means, and at the same time slowly moving the slot ring against the knob ring, the gap is cleaned. However, if it is desired to adjust the gap width with very high accuracy, the screening apparatus must be emptied and scavenged clean before adjustment of the gap width is carried out. The scavenging operation is carried out, for example, such that water is fed into the screening apparatus through one of its inlets or outlets.

The fact that the slot ring is located so that fibrous suspension substantially cannot pass between the slot ring and bottom portion means that, in the case when the tightly fitting slot ring abuts the support means, the fibrous suspension substantially shall not be permitted to pass between the support means and the bottom portion.

In order to prevent fibrous suspension from passing between the slot ring and the bottom portion and thus between the screen chamber and lower accept chamber, a sealing means, for example, can be placed in the lower accept chamber.

The screen means 5 can be any kind of screen means with screen openings of a suitable size for passing through the desired portion of the pulp suspension. The screen means, for example, can have slits with openings between about 0.1 mm and 0.5 mm, or holes with hole diameters between about 0.1 mm and 12 mm.

A screening apparatus according to the present invention can be used both detached and in combination with other screening apparatus in a common screen housing.

The inlets and outlets of the screening apparatus can be located in other places, and their number can be greater than that indicated at the embodiment shown herein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for screening a fibrous suspension comprising a housing, a rotary screen mounted for rotation within said housing, said rotary screen including an upper end, a lower end, and a knob ring disposed at said lower end of said rotary screen, a screen chamber between said rotary screen and said housing including an inner surface defined by said rotary screen, an outer surface and a lower surface, an inlet for providing said fibrous suspension to said screen chamber, a reject outlet for withdrawing a reject portion of said fibrous suspension from said screen chamber, an accept outlet for withdrawing an accept portion of said fibrous suspension from said rotary screen, an outer screen chamber surface defining said outer surface of said screen chamber, a bottom screen chamber surface defining said lower surface of said screen chamber, a slot ring associated with said bottom screen chamber surface and adjacent to said knob ring defining a gap therebetween, and adjustment means for movably adjusting the location of said slot means whereby the size of said gap may be adjusted and said fibrous suspension may be substantially prevented from passing from said screen chamber through said gap, said adjustment means being at a location whereby said gap may be adjusted from outside of said housing.

2. The apparatus of claim 1 wherein said adjustment means is attached to said bottom screen chamber surface.

3. The apparatus of claim 2 wherein said adjustment means comprises a rotary screw attached to said slot ring and including threads having a predetermined pitch, and wherein said rotary screw and said slot ring are movable with respect to said bottom screen chamber surface.

4. The apparatus of claim 1 including support means disposed at said bottom screen chamber surface within said screen chamber, said slot ring being fittingly attached to said support means, at least a portion of said support means being movable with said slot ring.

5. The apparatus of claim 4 wherein said support means includes an outer support ring and wherein said at least a portion of said support means comprises an inner support ring.

6. The apparatus of claim 5 wherein said support means extends over said entire bottom screen chamber surface.

7. The apparatus of claim 6 wherein said outer support ring is detachable.

8. The apparatus of claim 7 wherein said support means extends at least partially over said outer screen chamber surface.

9. The apparatus of claim 6 wherein said reject outlet comprises a congruent opening in said bottom screen chamber surface, and wherein said outer support ring is rotary, whereby said congruent opening of said reject outlet is adjustable thereby.

* * * * *